United States Patent [19]

Henry

[11] Patent Number: 4,872,669

[45] Date of Patent: Oct. 10, 1989

[54] ADJUSTABLE RESISTANCE EXERCISER

[76] Inventor: Harry M. Henry, P.O. Box 533, Paradise, Calif. 95967

[21] Appl. No.: 296,017

[22] Filed: Jan. 12, 1989

[51] Int. Cl.[4] ..... A63B 21/00

[52] U.S. Cl. ..... 272/132; 272/134; 272/DIG. 4

[58] Field of Search ..... 272/117, 118, 123, 131, 272/132, 134, DIG. 4

[56] References Cited

U.S. PATENT DOCUMENTS

| | | | |
|---|---|---|---|
| 3,524,644 | 8/1970 | Kane | 272/134 |
| 4,285,515 | 8/1981 | Gezari | 272/134 X |
| 4,408,759 | 10/1983 | Reneau et al. | 272/132 X |
| 4,436,303 | 3/1984 | McKillip et al. | 272/132 |
| 4,621,810 | 11/1986 | Commins | 272/134 |
| 4,720,099 | 1/1988 | Carlson | 272/134 |
| 4,722,522 | 2/1988 | Lundgren | 272/117 |
| 4,795,149 | 1/1989 | Pearson | 272/134 X |
| 4,822,038 | 4/1989 | Maag | 272/134 |

*Primary Examiner*—V. Millin
*Assistant Examiner*—Robert W. Bahr

[57] ABSTRACT

An adjustable resistance exerciser for gymnasts is provided in a vertical frame attached to a squared base platform. A horizontal pivotable handlebar is affixed at the ends to length adjustable side arms which are in turn attached by reversed sprag clutches to individual disc brakes. The disc brakes are supported by box shaped carriages arranged to be moved vertically up and down in paralleling track-like side members which make up the vertical frame. Opposite torque can be applied to either arm by manually adjusting the braking. The side arm length adjustments and the up and down carriage adjustment can be locked into selected positions which allows the device to be sized for a variety of users.

8 Claims, 5 Drawing Sheets

ADJUSTABLE RESISTANCE EXERCISER

BACKGROUND OF THE INVENTION

1. Field of the Invention

This invention relates to exercise equipment designed primarily for use by gymnasts for strengthening generalized muscle groups. The devices are adjustable in size and applied torque according to the needs of the user. In the immediate invention, a pivoting handle bar rotates on two independent sprag clutches with the abduction action capable of independent variable torque adjustment over the adduction movement.

2. Description of the Prior Art

Exercise and physical therapy equipment designed for manipulation of human muscles groups have been in use for a considerable time. Weight lifting has been the prime mover for eons. A variety of mechanical devices now supplements or completely replaces weight lifting as the equipment of choice in many muscle building gymnasiums. In keeping with the modern trend, the present invention is a unique variation in a complete mechanical muscle exerciser designed as a weight lifting supplement. The main purpose of this invention, however, is providing an all purpose adjustable tension device particularly useful by gymnasts.

SUMMARY OF THE INVENTION

In developing a device useful for the type of exercising required by the gymnast, I provide in my invention mechanics directed towards that need. My invention is basically a horizontally aligned tubular handlebar attached pivotally by adjustable side arms to a handlebar carriage and braking mechanism affixed to a vertical support frame. The vertical frame fits removably into short tubular base tubes attached vertically along the sides towards one edge of a substantially square platform. The platform is a tubular frame supported horizontal panel structured to adequately support the exerciser superstructure and a human user. Leveler feet under the support frame allow adjusting the platform to a useful level position. Non-slip padding on the upper surface of the platform provides the user with safe and sure footing during exercising. The edge of the platform towards which the vertical support frame attaches is designated the back with the opposite edge being designated the front. The sides are designated right side and left side in relationship to a user standing behind and facing towards the handlebar.

The vertical support frame consists of four main vertical square tubular members placed in track-like pairs. One pair is positioned on each side of the rectangular platform towards the back. Two short horizontal frame members for each pair of vertical supports, one at the top and one somewhat below midway, connect the two vertical support frame members together and maintain the track-like positions of the pairs. Two long horizontal frame members paralleling the back edge of the platform maintain the vertical alignment of the two pairs of vertical support frame members. One long horizontal frame member is at the top of the support frame structure and the other attaches approximately midway between the pairs. A narrow padded backboard is affixed centrally vertically between the two long horizontal frame members.

The pivoting handlebar is part of a U-frame assembly attached at the opened end movably to the vertical framing members by means of a handlebar carriage. The handlebar carriage rides like an elevator in the track-like arrangement formed by the pairs of vertical support members. The handlebar carriage includes a disc brake system which functions to provide torsion to the rotating handlebar. Braking calipers are manually adjustable against a disc to provide the required torsion. The connection between the braking system and the distal ends of the handlebar assembly is made by means of a sprag clutch which permits one way rotation of the shaft and disc brake. One handlebar arm is restricted when moved upwardly and the other is restricted when moved downwardly. Both handlebar side arms turn simultaneously with selected adjustable braking being applied in both up and down movements of the handlebar. This allows variation between the torsion applied to the abduction and adduction movements of the handlebar. The horizontally positioned handlebar is mounted perpendicularly solidly to the two parallel side arms. The parallel side arms are structured of square tubing which in turn is telescopically fitted into two mounting arms which are endwardly attached to the sprag clutch. For adjusting the length of the parallel side arms, an axle is incased in the tubular handlebar. Each end of the axle is affixed with a bevel gear which turns a bevel gear on the end of a jack screw encased in the side arms. A screw nut embedded in the inner end of each side arm extending member rides along the jack screw and shortens or lengthens the side arms by pull adjustment or adjustments made by turning a wheel knob at one end of the handlebar. A jack screw limiting washer bolted to the end of the jack screw prevents the two telescoping arm sections from separating. This arrangement removes slop in the handlebar telescoping fittings, provides the handlebar assemblage with precise adjustments, and maintains the handlebar in parallel alignment with the front platform edge. Knobbed turn down lock bolts in both adjustment arms prevents undesired movement after the handlebar has been adjusted for the user.

An overhead sprocket and a vertical chain combination raises and lowers the handlebar carriage in the track-like pairs of vertical support structures. A crank fitting on the end of a shaft to which the sprockets are attached is used to adjust the position of the handlebar carriage. The sprocket shaft is attached in parallel alignment adjacently above the upper long horizontal support member. Positive locking of the sprocket shaft is accomplished by a double bar loose bolt hinge lock. The loose bolt allows an upper bar over the sprocket shaft to be locked down on a lower bar under the sprocket shaft by a thumb turn screw opposite the loose bolt. The loose bolt acts like a hinge and a second side bolt locks the double bars as a extra precaution. The handlebar carriages, one in each pair of track-like vertical support pairs, is additionally locked into position manually y turn-down screw knob bolt locks.

As previously mentioned, my exerciser is directed towards use by gymnasts. It is designed to strengthen the arm, stomach, thigh, and leg muscles of the gymnast. The user stands on the platform and the equipment is adjusted both in size and tension for that particular user. The user presses his or her back against the padded backrest. When the handle bar is lowered and raised from a position below the user's waist to a position of arms fully stretched upward above the user's head, the full range of leg to arm muscles, including thigh, stomach, and chest, are effectively exercised.

Therefore, a primary object of the invention is to provide a complete leg to arm exerciser for gymnasts in a single device.

Another object of my invention is to provide in a single exercising device multi adjustments so the single device can be sized and conditioned for use according to the size and requirements of the user.

A further object of the invention is to provide a multiple adjustment exerciser particularly for gymnasts with fixtures easily dismantable for transportation or storage.

Other objects and the many unique features of the this invention will become clear and understood by reading descriptions of numbered parts in the following specification and comparing the described numbered parts with like numbered parts illustrated in the accompanying drawings.

BRIEF DESCRIPTION OF THE DRAWINGS

In the drawings:

FIG. 2 shows the exerciser in a left side view of which a right side view would be substantially similar.

DRAWING REFERENCE NUMERALS

Figure 1:
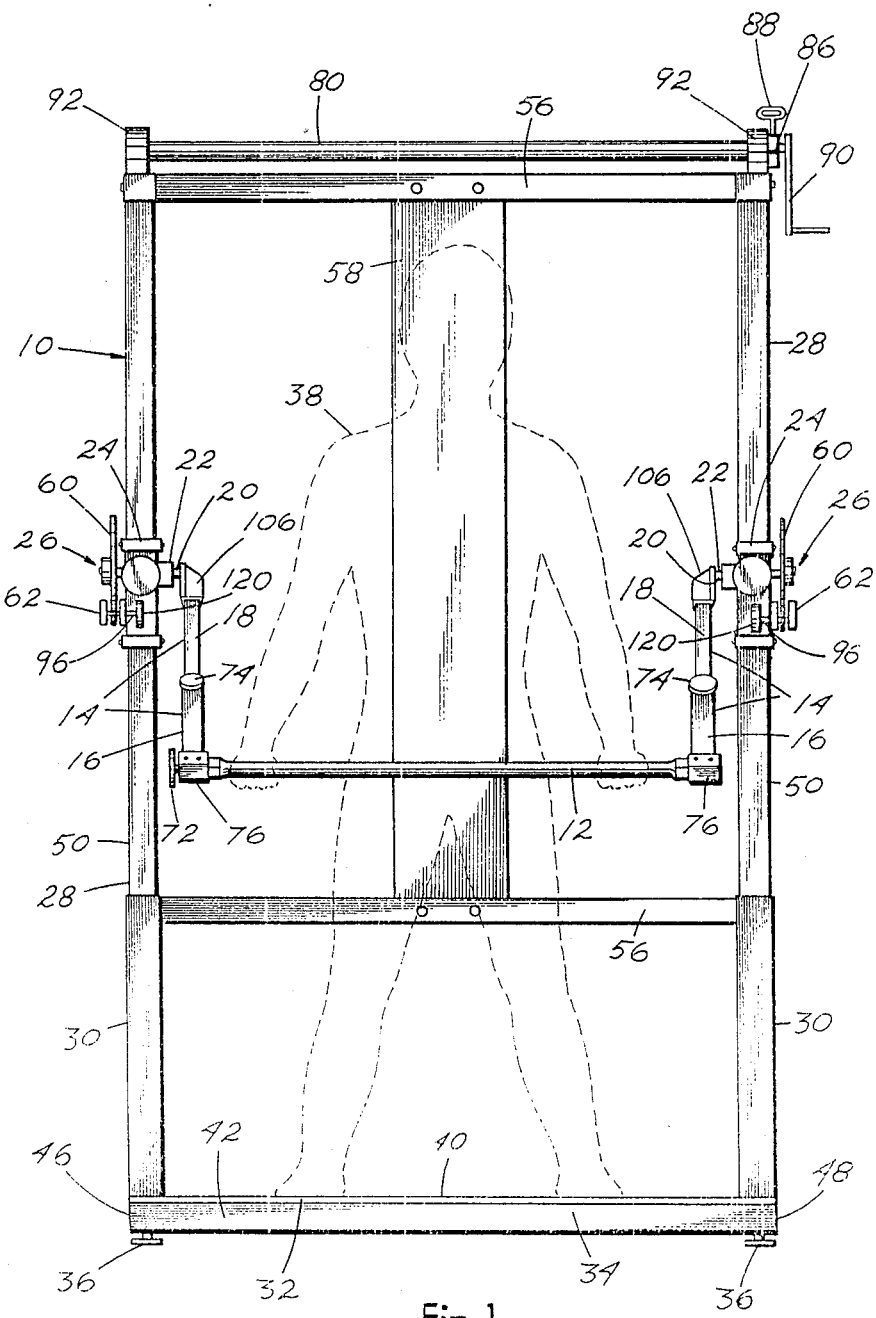
FIG. 1 is a frontal view of the adjustable resistance exerciser illustrating a user in dotted lines facing the handlebar with his back to the padded backboard.

10 exerciser structure
12 tubular handlebar
14 adjustable handlebar side arm members
16 outer telescoping arm member
18 inner telescoping arm member
20 sprag clutch attachment
22 sprag clutch
24 handlebar carriage
26 braking system
28 vertical frame
30 short tubular base members
32 platform
34 platform tubular support frame
36 leveler feet
38 human user
40 non-slip padding
42 platform front
44 platform back
46 platform right side
48 platform left side
50 vertical tubular members
52 track-like pairs.
54 short horizontal frame members
56 long horizontal frame members
58 narrow padded backboard
60 brake disc
62 braking calipers
64 handlebar adjustment axle
66 bevel gears
68 jack screw nut
70 jack screw
72 arm length adjust wheel
74 knobbed turn down lock bolts
76 arm bevel gear housing
78 jack screw limiting washer
80 sprocket axle
82 sprocket
84 chain
86 sprocket clamp lock
88 manual clamp lock tightner
90 handlebar carriage position adjust crank
92 sprocket housing
94 tubular bracing
96 brake torsion control
98 loose bolt hinging
100 handlebar movement
102 jack screw end bolt
104 arm attachment gear
106 arm attachment gear housing
108 clutch shaft
110 chain stirrup
112 bearings
114 guide pin
116 brake pad
118 brake pressure adjust bolt
120 brake pressure adjust bolt knob
122 shoulder bolt
124 secondary carriage lock
126 secondary carriage lock slot
128 assembly bolts
130 axle support
132 horizontal track brackets
134 vertical track brackets

DESCRIPTION OF THE PREFERRED EMBODIMENT

Figure 2:
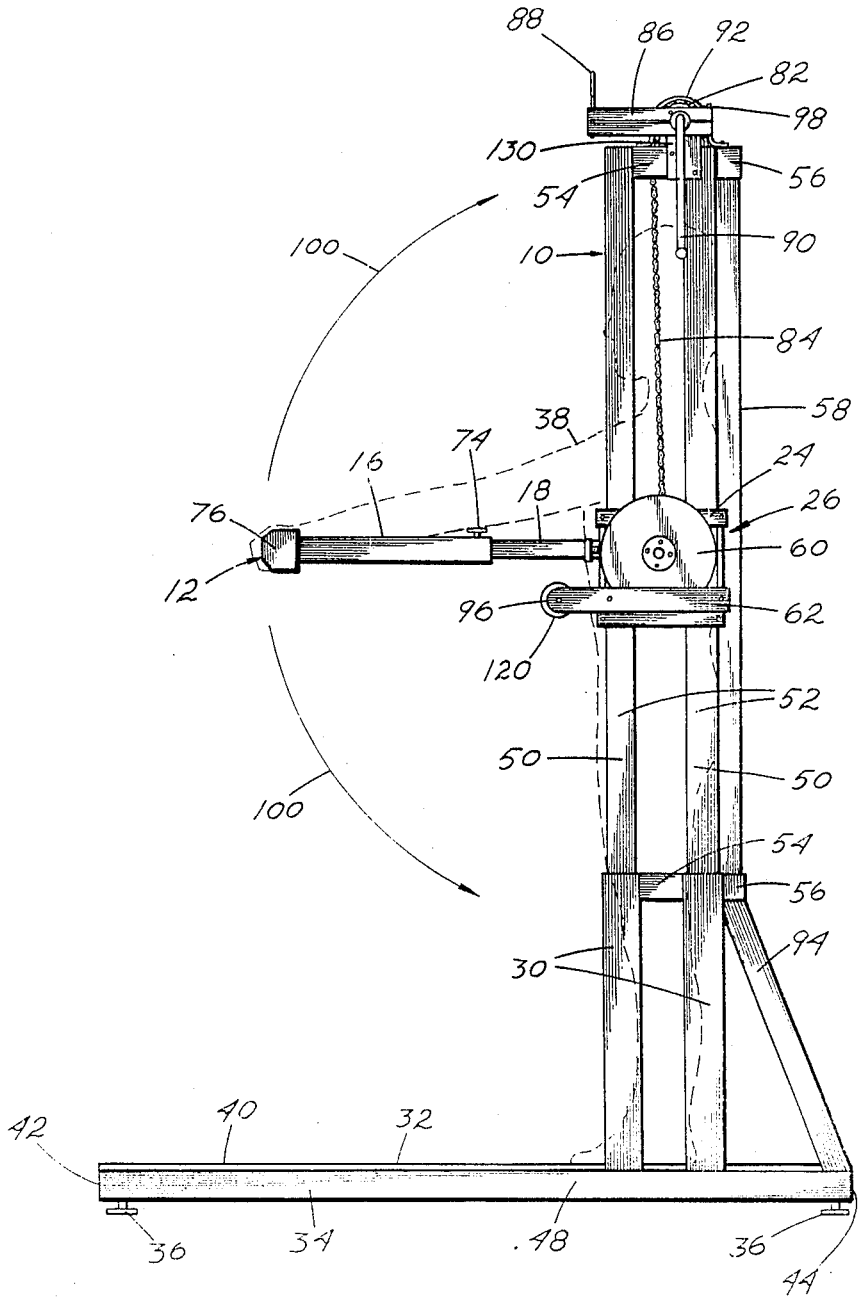

Referring now to the drawings at FIG. 1 and FIG. 2 and to exerciser structure 10. A single horizontally aligned tubular handlebar 12 is attached pivotally by two adjustable handlebar side arm members 14 to sprag clutches 22 at sprag clutch attachments 20 which in turn are affixed to handlebar carriage 24. Handlebar carriage 24 is a box-shaped structure apertured centrally with a bearing 112 shaft and affixed upwardly by a chain stirrup 110 to which a supporting chain 84 is attached. See FIG. 4 for details. Handlebar carriage 24 which supports braking system 26 is affixed mobile to move elevator-like between the track-like pairs 52 of vertical frame 28. At the top of vertical frame 28 a sprocket axle 80 runs transversely and is supported mobile by axle support 130, one at each end. Just inside of axle support 130 at each end of sprocket axle 80 is sprocket 82. A chain 84 around sprocket 82 attached to handlebar carriage 24. The chain and sprocket arrangement is explained in detail further on in this specification.

The working space between tubular handlebar 12 and vertical frame 28 is precisely adjustable through mechanics inside outer telescoping arm member 16 and inner telescoping arm member 18. These mechanics are described further on in this specification. The lower ends of vertical tubular members 50 which make up vertical frame 28 fit removably into short tubular base members 30 attached along the sides towards one edge of platform 32. Platform 32 is a substantially square horizontally positioned panel. A platform tubular support frame 34 under platform 32 provides a base structured to adequately support the exerciser structure 10 and a human user 38. Leveler feet 36 under platform support frame 34 allows adjusting platform 32 to a useful level position. Non-slip padding 40 on the upper surface of platform 32 provides human user 38 with safe and sure footing during exercising. The edge of platform 32 towards which vertical frame 28 and short tubular base 30 attach is designated platform back 44 with the opposite edge being designated platform front 42. The sides of platform 32 are designated platform right side 46 and platform left side 48 relative to human user 38 standing behind and facing towards tubular handlebar 12. As can be seen in FIG. 2, vertical frame 28 consists of four main vertical tubular members 50 placed in track-like pairs 52. One track-like pair 52 is positioned on each side of platform 32 towards platform back 44. Two short horizontal frame members 54 for each track-like pair 52 of vertical frame 28, one at the top and one somewhat below midway, connect the two vertical tubular members 50 together and maintain the track-like positions of track-like pairs 52. Two long horizontal frame members 56 paralleling the platform back 44 edge of platform 32 maintain transverse vertical alignment of track-like pairs 52 which form vertical frame 28. One long horizontal frame member 56 is at the top of vertical frame 28 and the other attaches approximately midway between the rearward positioned vertical tubular members 50. A narrow padded backboard 58 is affixed centrally vertically between the two long horizontal frame members 56. Tubular bracing 94 supports the short tubular base 30.

The lower ends of each vertical tubular members 50 are removably retained within short tubular base members 30 which are vertical tubular supports permanently affixed and braced through the top edges of platform 32 directly to platform tubular support frame 34 adjacent platform back 44. Tubular handlebar 12 is attached pivotally to the vertical frame 28 by means of handlebar carriage 24. Handlebar carriage 24 rides up and down like an elevator in the track arrangement formed by track-like pairs 52 of vertical tubular members 50. Handlebar carriage 24 supports braking system 26 which includes disc brake 60, braking calipers 62, controllable by brake torsion control 96 at brake pressure adjust bolt knob 120, and sprag clutch 22 to which adjustable handlebar side members 22 are attached. Brake pressure adjust bolt knob 120 in braking system 26 functions to provide controllable torsion by brake torsion control 96 to rotational handlebar movement 100. See FIG. 2.

Figure 3:
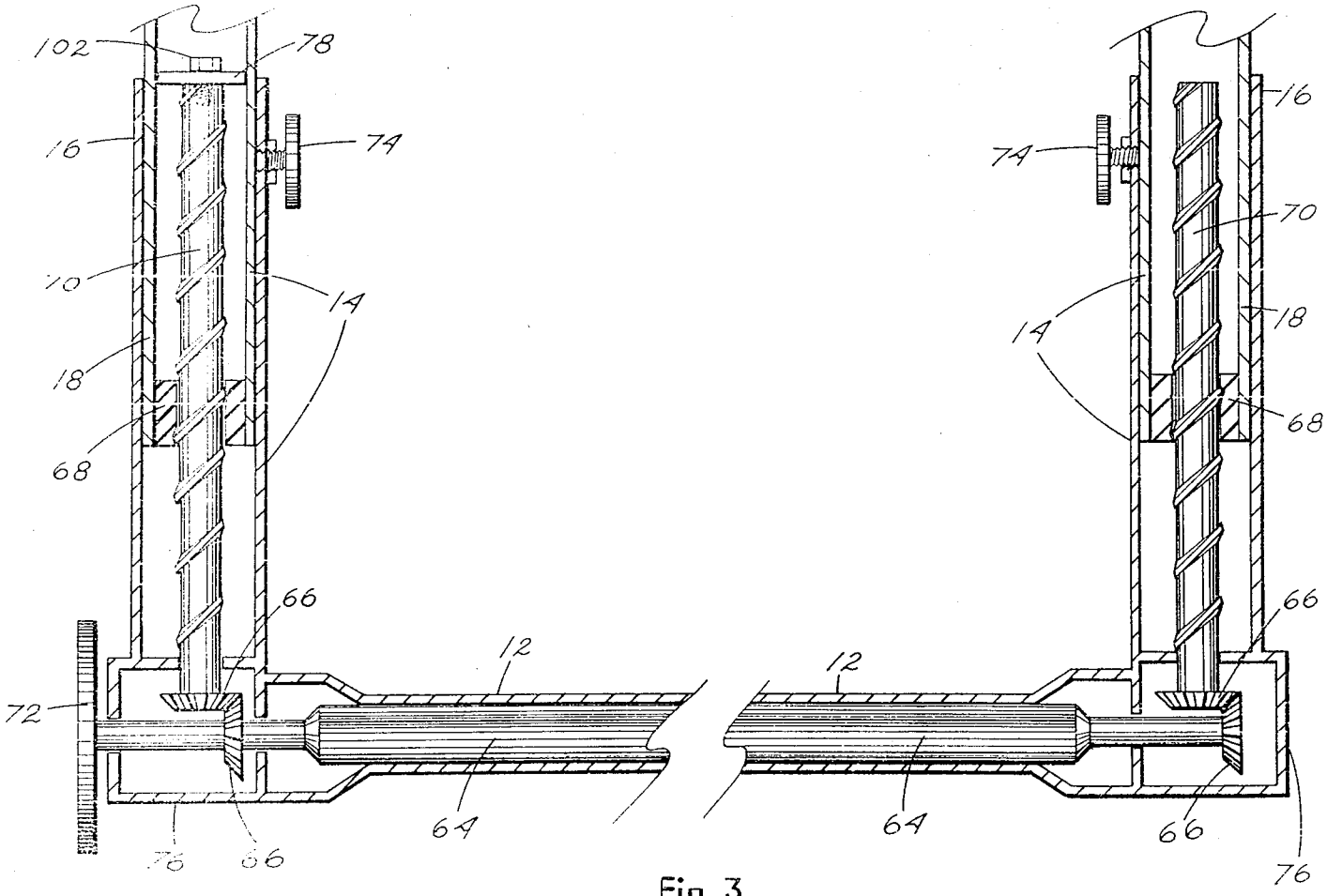
FIG. 3 is a sectional view of the handlebar and handlebar assembly illustrating the precise length adjustment mechanics.

In FIG. 3, the precise mechanics inside of adjustable handlebar side arm members 14 for shortening and lengthening the arms is illustrated. Inside of tubular handlebar 12 is handlebar adjustment axle 64 having bevel gears 66 at both ends connected with bevel gears 66 on the ends of jack screws 70. Jack screws 70 run perpendicular to handlebar adjustment axle 64 and are housed inside of adjustable handlebar side arm members 14. A jack screw nut 68 attached to the inside of inner telescoping arm member 18 moves along jack screw 70 when handlebar adjustment axle 64 is turned by arm length adjust wheel 72. The movement shortens or lengthens adjustable handlebar side arm member 14 when inner telescoping arm member 18 moves inside of outer telescoping arm member 16. When in the desired position, knobbed turn down lock bolts 74 can be tightened and the two arm sections retained in place. With knobbed turn down lock bolts 74 loosened, the arm adjustment mechanics are sufficiently smooth that inner telescoping arm member 18 can be pulled or pushed manually into a desired position by pressure applied against tubular handlebar 12. The illustrations at FIG. 3 show bevel gears 66 housed in arm bevel gear housing 76 and a jack screw limiting washer 78 held in the end of jack screw 70 by jack screw end bolt 102 which prevents the two telescoping arm sections from separating at the end of the screw run.

Figure 4:
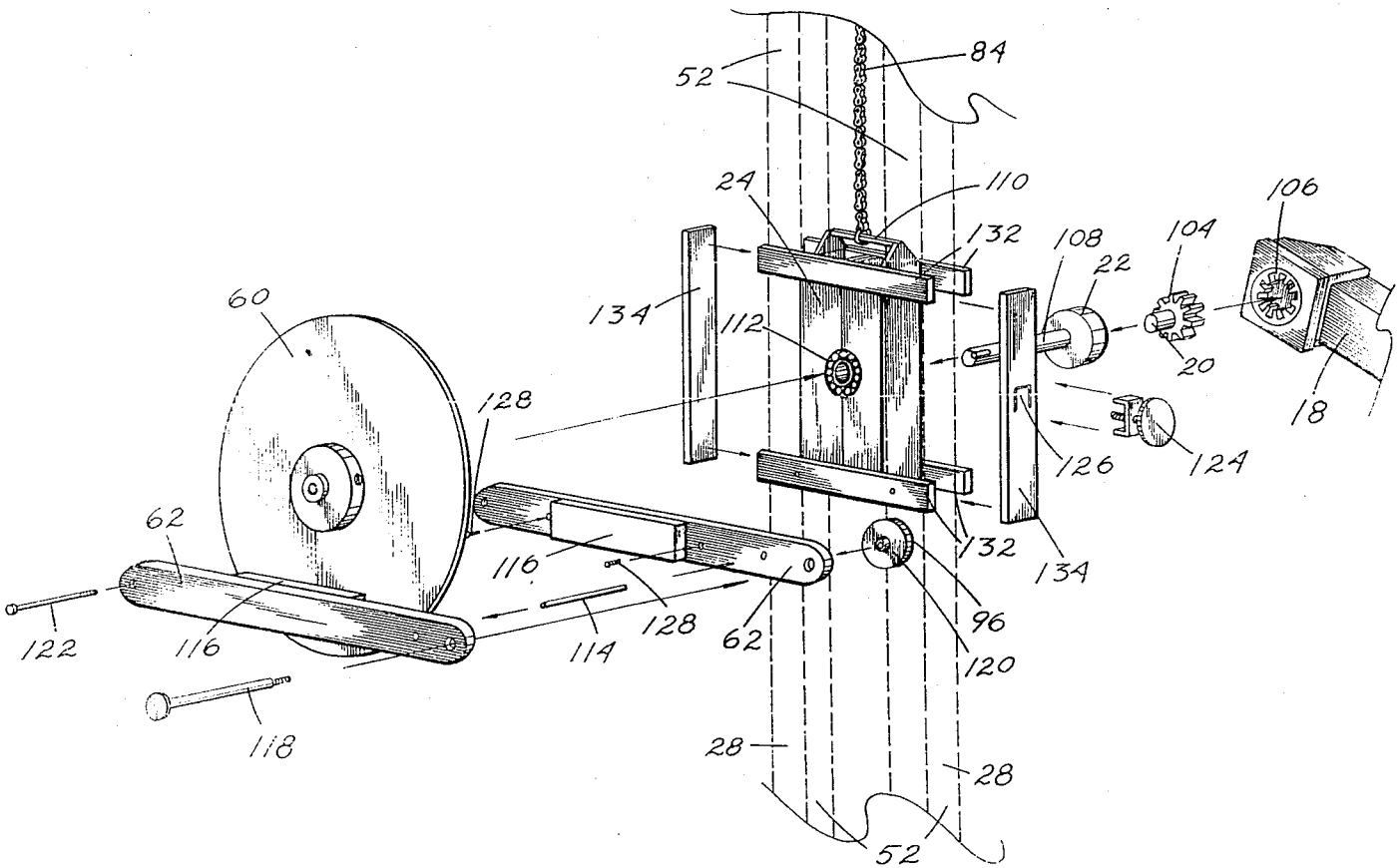
FIG. 4 is an exploded view of the disc braking system and sprag clutch to which the handlebar arms attach.

FIG. 4 illustrates the handlebar carriage 24, the braking system 26, the sprag clutch 22, the sprag clutch attachment 20 with arm attachment gear 104, and the arm attachment gear housing 106 at the end of inner telescoping arm member 18 in an exploded drawing. Handlebar carriage 24 is adjustable up and down in track-like pairs 52 of vertical tubular members 50 by chain 84 attached to chain stirrup 110. Inner telescoping arm 18 attaches by arm attachment gear housing 106 to arm attachment gear 104 and sprag clutch attachment 20. Sprag clutch attachment 20 fits into sprag clutch 22 which in turn is attached by clutch shaft 108 inserted through bearing 112. The inside braking caliper 116 attaches to lower horizontal track bracket 132 by assembly bolts 128. Brake disc 60 is positioned on clutch shaft 108 opposite sprag clutch 22 faced against brake pad 116. The outside braking caliper 62 is attached with brake pad 116 against the outside face of brake disc 60 by shoulder bolt 122 and brake pressure adjust bolt 118. A guide pin 114 is aligned through the two calipers 62 in aligned apertures to prevent side movement of the calipers during braking. Braking is accomplished by turning brake pressure adjust bolt knob 120 which tightens down on brake pressure adjust bolt 118 putting braking pressure against brake disc 60 from brake pads 116 as braking calipers 62 are pulled towards each other. Brake pressure adjust bolt knob 120 is also the brake torsion control 96 which applies reversed torsion to adjustable handlebar side arm members 14. Handlebar carriage 24 is suspended elevator-like between the track-like pairs 52 of vertical tubular members 50 which make up vertical frame 28. Horizontal track brackets 132 maintain handlebar carriage 24 in track-like pairs 52 of vertical frame 28. Vertical track brackets 134 attach to horizontal track brackets 132 on the outside of vertical tubular members 50 as end guides. Secondary carriage lock 124 inserted through secondary carriage lock slot 126 can be tightened and loosened to hold handlebar carriage 24 in a locked position.

Figure 5:
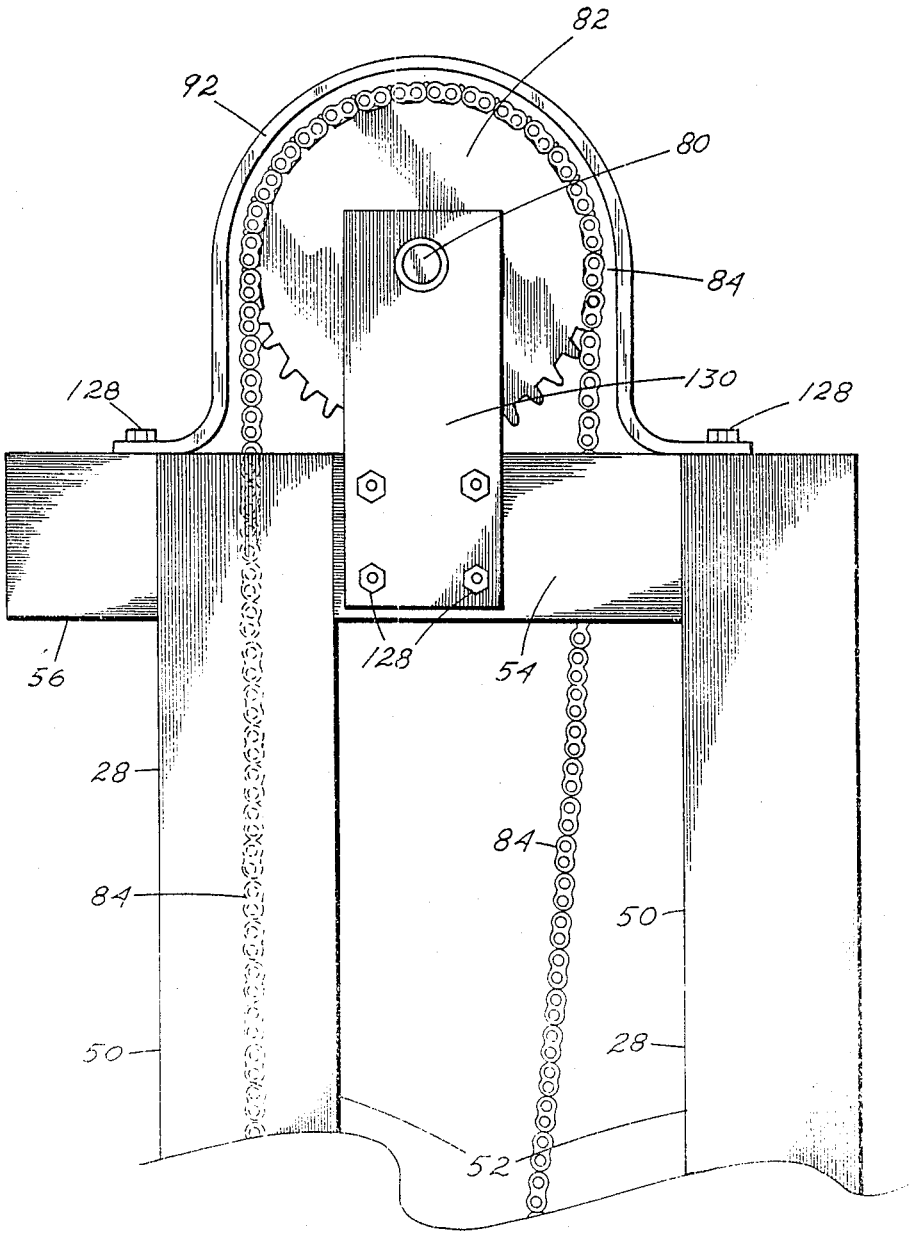
FIG. 5 is an enlarged partial view of the overhead sprocket and chain assembly illustrating the work chain section between track-like members of the vertical support frame and the free end encased inside a tubular frame member.

As illustrated in FIG. 5 in a view from platform right side 46, overhead sprocket 82 housed in sprocket housing 92 operates vertical chain 84 which raises and lowers handlebar carriage 24 in track-like pairs 52 of vertical frame 28. The support side of chain 84 is positioned between track-like pairs 52 of vertical tubular members 50 with the free side of chain 84 protectively encased inside the rearward vertical tube member 50. In platform left side 48 view of FIG. 2, handlebar carriage position adjust crank 90 on the end of sprocket axle 80 can be seen and is used to adjust the up and down position of handlebar carriage 24. Sprocket axle 80 is attached in parallel alignment with and adjacently above the upper long horizontal frame member 56. See FIG. 1. Positive locking of sprocket axle 80 is accomplished by sprocket clamp lock 86, a double bar loose bolt hinge 98 lock. The loose bolt hinging 98 allows an upper bar over sprocket axle 80 to be locked down on a lower bar under sprocket axle 80 by a thumb turn screw, manual clamp lock tightner 88, opposite the loose bolt hinging 98 end. A second side bolt locks the double bars as a extra precaution.

To exercise, human user 38 stands with his/her back braced against narrow padded backboard 58, grasps tubular handlebar 12 with both hands and rotates tubular handlebar 12 from an arms down position in the knee area to an arms fully stretched overhead position. Braking calipers 62 are manually adjustable at brake torsion control 96 to press against brake disc 60 and provide the required torsion. The connection between braking system 26 and tubular handlebar 12 being sprag clutch 22 permits only one way rotation of clutch shaft 108 and brake disc 60. This allows variation between the torsion applied to the abduction and adduction movements of tubular handlebar 12.

As my exerciser structure 10 is directed towards use by gymnasts, the design is primarily to strengthen the arm, stomach, thigh, and leg muscles of the gymnast. Human user 38 stands on platform 32 and the equipment is adjusted both in size and tension for that particular human user 38. Human user 38 presses his or her back against narrow padded backboard 58. When tubular handlebar 12 is lowered and raised from a position below human user's 38 waist to a position of arms fully stretched upward above human user's 38 head, the full range of leg to arm muscles, including thigh, stomach, and chest, are effectively exercised.

Though I have described my adjustable resistance exerciser in a particular structure in the foregoing specification, it is obvious that one skilled in the art could modify the device in useful forms for similar standup gymnastic exercising; therefore, any changes made which fall within the spirit and scope of my appended claims will be considered as my invention.

The embodiments of the invention in which an exclusive property of privilege is claimed are defined as follows:

1. An exercise device comprising:

a frame including a pair of elongated, vertically oriented track members and a base for maintaining the vertical orientation of said track members;

a handlebar means including an elongated tubular handlebar being horizontally lengthwise oriented, and a pair of handlebar side arms, each handlebar side arm being affixed to an end of said tubular handlebar at a right angle;

a carriage mounted on each vertically oriented track member, each handlebar side arm being pivotally attached to a carriage;

adjustment means for adjusting the position of each carriage along said track member including a pair of sprockets each pivotably mounted at the upper end of each track member, a pair of chains each connected at one end to a carriage and trained about a sprocket, a turnable axle connecting said sprockets, a crank connected to said turnable axle for manually turning said sprockets and thereby adjusting the position of said carriages along said track members, and means for locking said carriages in a selected position along said track members;

a braking means mounted on each carriage for providing resistance to pivotal movement of said handlebar means, each braking means being individually adjustable; and, a back rest mounted on said base between and said track members.

2. The exercise device of claim 1 further comprising means for adjusting the length of said handlebar side arms, said means including jack screws housed inside each handlebar side arm, said jack screws having bevel gears at the end proximate said handlebar, an adjustment axle housed inside said handlebar, said adjustment axle having bevel gears meshing the bevel gears of said jack screws, each handlebar side arm comprising a pair of tubular telescoping members, the inner member having a jack screw nut arranged to move along said jack screw during rotation of said jack screw, and an adjustment wheel external of said handlebar such that rotation of said adjustment wheel causes rotation of said adjustment axle and said jack screw which in turn causes movement of the outer telescoping member with respect to the inner telescoping member.

3. The exercise device of claim 2 further comprising a locking bolt for locking the inner and outer telescoping members of said handlebar side arm together.

4. The exercise device of claim 1 wherein said back rest is a narrow vertically aligned board, said board being padded.

5. The exercise device of claim 1 wherein said braking means includes a brake disc, a pair of brake pad calipers and a control knob for adjusting the pressure of said brake pad calipers on said brake disc.

6. The exercise device of claim 1 wherein the means for locking said carriages along said track members includes a double bar clamp mounted about said turnable axle and a locking bolt for locking said double bar clamp on said turnable axle to selectively prevent rotation of said tunable axle.

7. The exercise device of claim 1 further comprising a secondary locking means for locking said carriages along said track members, said secondary locking means including a locking screw mounted on each carriage for selectively locking each carriage to a track member.

8. The exercise device of claim 1 further comprising means for leveling said base.

* * * * *